United States Patent [19]

Brayford et al.

[11] 4,332,764

[45] Jun. 1, 1982

[54] METHODS FOR PRODUCING MELT-SPUN FILAMENTS

[75] Inventors: John R. Brayford, Charlotte; Max L. Cardell, Shelby, both of N.C.

[73] Assignee: Fiber Industries, Inc., New York, N.Y.

[21] Appl. No.: 199,321

[22] Filed: Oct. 21, 1980

[51] Int. Cl.[3] ..... D01D 1/04

[52] U.S. Cl. ..... 264/176 F; 264/210.3; 264/237; 425/72 S

[58] Field of Search ..... 264/176 F, 237, 136, 264/210.3; 425/72 S

[56] References Cited

U.S. PATENT DOCUMENTS

| | | | |
|---|---|---|---|
| 1,943,353 | 1/1934 | Taylor | 264/204 |
| 2,373,078 | 4/1945 | Kleist | 264/204 |
| 2,931,422 | 4/1960 | Long | 425/8 |
| 3,041,663 | 7/1962 | Green | 264/176 F |
| 3,067,459 | 12/1962 | Brand | 264/176 F |
| 3,070,839 | 1/1963 | Thompson | 264/176 F |
| 3,135,811 | 6/1964 | Barnett et al. | 264/176 F |
| 3,259,681 | 7/1966 | Bull et al. | 264/176 F |
| 3,650,716 | 3/1972 | Brossard | 425/8 |
| 3,781,393 | 12/1973 | Feltgen et al. | 156/167 |
| 3,858,386 | 1/1975 | Stofan | 269/205 |
| 3,969,462 | 7/1976 | Stofan | 264/210.8 |
| 3,988,086 | 10/1976 | Marshall et al. | 264/210.8 |
| 4,000,238 | 12/1976 | Maurer | 264/176 F |
| 4,038,357 | 7/1977 | Boyes et al. | 264/168 |
| 4,204,828 | 5/1980 | Peckinpaugh et al. | 425/72 S |
| 4,259,048 | 3/1981 | Miani | 264/176 F |

FOREIGN PATENT DOCUMENTS

| | | | |
|---|---|---|---|
| 53-9293 | 4/1978 | Japan | 264/237 |
| 55-51808 | 4/1980 | Japan . | |
| 597751 | 3/1978 | U.S.S.R. | 264/237 |

OTHER PUBLICATIONS

*Chemiefasern Textilindustrie*, vol. 29/81, Oct. 1979, entitled "Quench Duct Filament Oiling".

*Primary Examiner*—Jay H. Woo

*Attorney, Agent, or Firm*—Roderick B. Macleod

[57] ABSTRACT

In the melt-spinning of filaments molten polymer is extruded downwardly through circularly arranged holes of a spinneret to form a circular group of filaments. Quench gas and finish liquid are conducted downwardly through the spinneret in alignment with a longitudinal axis defind by the filament group and are directed outwardly through the filament group. The filaments exhibit vibration during travel from the spinneret to the lower guide. The filaments are passed through and against a circular guide surface disposed around the filament group below the finish spray and above the lower guide. As a result, the filaments are deflected inwardly, in mutually spaced relationship, toward the longitudinal axis, whereby the amplitude of vibration of the filaments is reduced. The filaments are passed between walls extending upwardly from the guide surface and surrounding the filament group. Finish liquid is sprayed against the walls so that a finish environment is confined between the walls. The guide may comprise relatively movable members which close around the filament group to define a continuous guide surface.

11 Claims, 14 Drawing Figures

Fig. 5
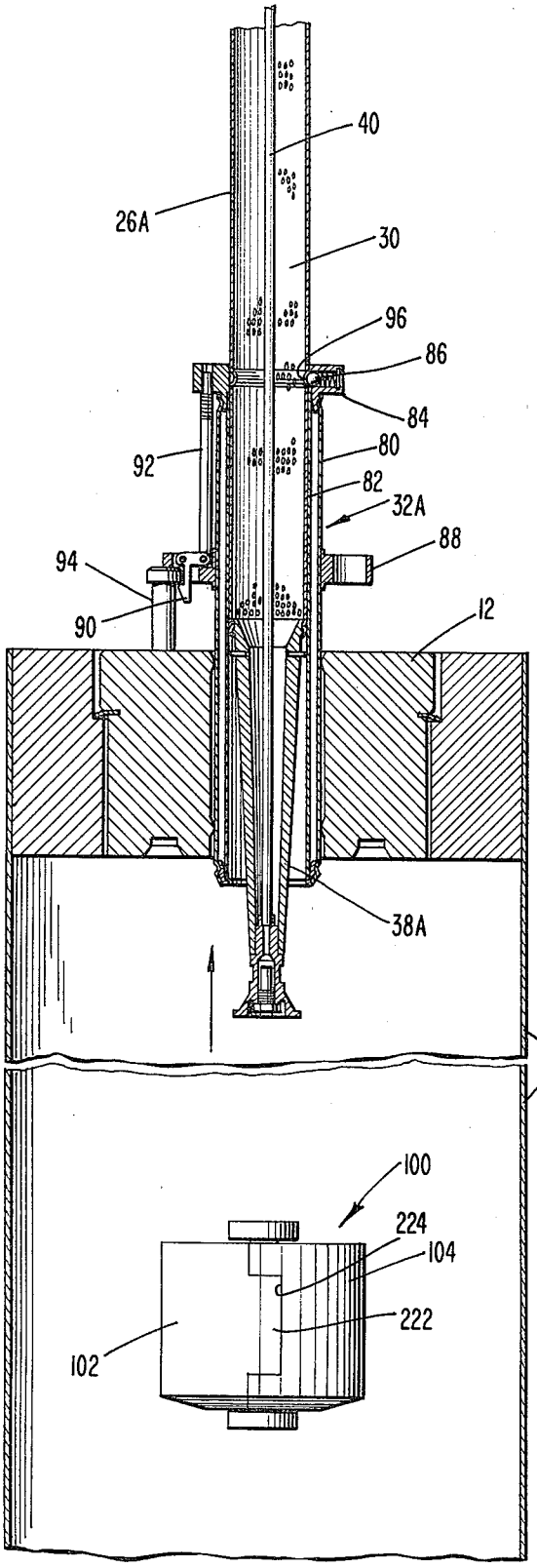
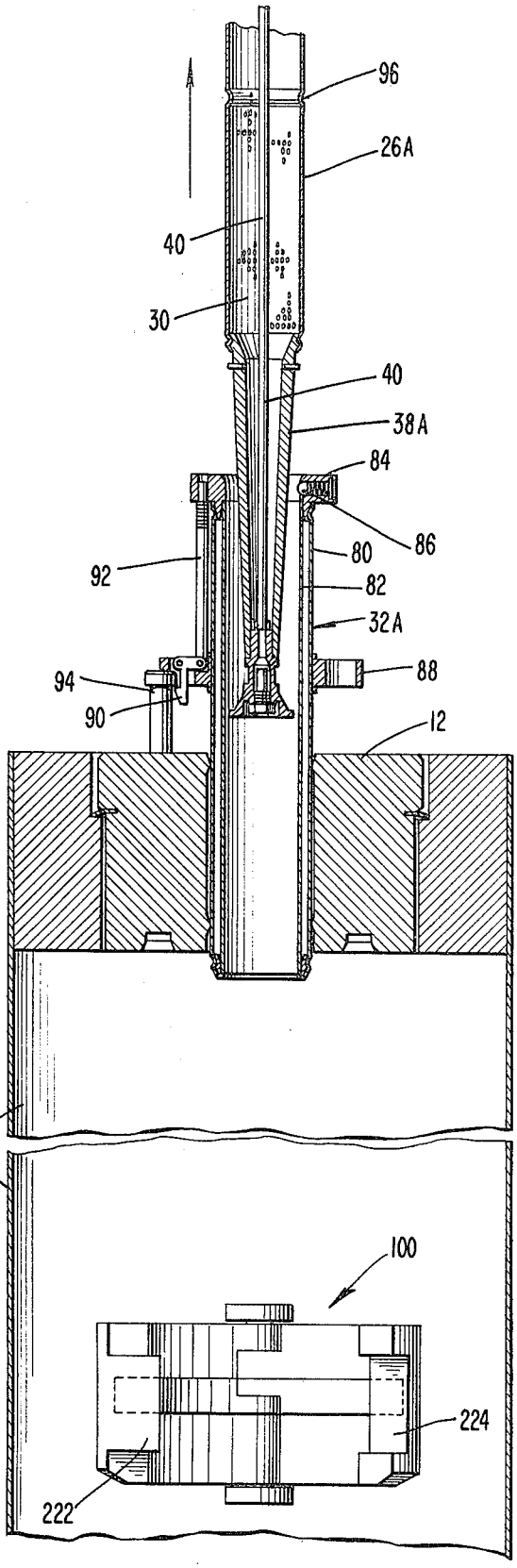
Fig. 6

METHODS FOR PRODUCING MELT-SPUN FILAMENTS

BACKGROUND OF THE INVENTION

The present invention relates to the manufacture of melt-spun filaments and, in particular, to a reduction in amplitude of vibration of spun filaments passing through quenching and finish application zones, and a reduction in haul-off tension.

The manufacture of melt-spun filaments is typically achieved by extruding a molten polymer, such as polyester, polyamide, etc., through a spinneret and then cooling the filaments thus formed. Therebelow, the filaments are converged and gathered at a guide and delivered to a bobbin or further treatment station.

Cooling of the filaments is traditionally accomplished in a quench zone by blowing a stream of cool gas such as air across the filaments emerging from the spinneret, as demonstrated for example in U.S. Pat. Nos. 3,067,459; 3,070,839; 3,135,811; 3,259,681; 3,858,386; and 3,969,462. The air may be directed radially outwardly from within a circular array of filaments, i.e., so-called outflow quench.

It is also common to apply a finishing liquid to the filaments below the quench zone to lubricate and impart antistatic properties to the filaments. Application of the finishing liquid may be performed by passing the filaments over a convergence guide, e.g., a so-called skid guide in which the filaments are bundled together in mutually contacting relationship while the finishing liquid is flowed or sprayed onto the bundle of filaments, as described for instance in U.S. Pat. Nos. 1,943,353; 2,373,078; 3,041,663; 3,067,459; and 3,988,086.

The degree of molecular orientation of the filaments, (i.e., birefringence), produced by the abovedescribed melt-spun techniques is influenced by a number of factors, which affect the amount of tension to which the filaments are subjected upon emergence from the spinneret, especially the intensity of cooling and finish application imparted to the filaments. Although acceptable levels of birefringence can be achieved by current techniques, it is often difficult to impart these qualities uniformly. The present inventors have recognized that one factor contributing to this problem involves a tendency of the filaments to oscillate while passing through the quench and finishing zones. It will be appreciated that in an outflow quench environment, an oscillating filament will contact the quench air flow at various upstream and downstream locations within the flow and will thus be subjected to different quench air velocities (i.e., the quench air velocity gradually decreases in the direction of air flow). Accordingly, the filaments may be quenched at varying and unequal rates. In addition, the oscillating filaments may collide before being sufficiently cooled, thereby tending to coalesce.

Although the presence of a skid guide at which the filaments are bundled may result in a slight reduction in the amplitude of vibration, as compared with the absence of such a skid quide, the problem of non-uniform quenching and finish application is far from alleviated.

Another problem encountered in filament spinning operations involves the tendency for breakage or damage to occur due to the high amounts of tension to which the filaments may be subjected. One cause of such high tension is air drag which results from the tendency of the rapidly-traveling filament group to induce a substantial air flow. Besides being more susceptible to damage, the highly tensioned filaments require that greater amounts of energy be expended for maintaining the filaments at the required travel speeds.

SUMMARY OF THE INVENTION

The present invention concerns melt-spinning of the type wherein molten polymer is extruded downwardly through annularly arranged holes of a spinneret to form an annular group of filaments. Quench gas is directed from within the filament group and outwardly therethrough. Finish liquid is sprayed from within the filament group and outwardly therethrough beneath the quench gas. The filaments are gathered and redirected at a lower guide. The filaments exhibit vibration during travel from the spinneret to the lower guide. The filaments are passed through an upper guide disposed around the filament group below the finish spray and above the lower guide such that the upper guide is lubricated by the finish spray and the filaments are acted inwardly upon by the upper guide and deflected, in mutually spaced relationship, toward a longitudinal axis defined by the filament group, whereby the filaments are supported between the spinneret and the lower guide to reduce the amplitude of vibration of the filaments.

Preferably, the upper guide is in the form of an annular surface which surrounds and contacts the filaments.

Preferably, walls extend upwardly from the upper guide surface and surround the filaments to confine a finish environment around the filaments.

THE DRAWINGS

The advantages of the invention will become apparent from the following detailed description of a preferred embodiment thereof in connection with the accompanying drawings in which like numerals designate like elements, and in which:

FIG. 5 is a longitudinal sectional view taken through a modified form of quench and finish conductors in a retracted position, and depicting a modified upper guide in a closed condition;

FIG. 6 is a view similar to FIG. 5 with the quench and finish conductors partially removed from an insulator housing in the spinning pack, and with the modified upper guide in an open condition;

FIG. 10 is a longitudinal sectional view through the modified upper guide in a retracted, non-operative mode corresponding to FIG. 7;

DETAILED DESCRIPTION OF PREFERRED EMBODIMENTS OF THE INVENTION

Figure 1:
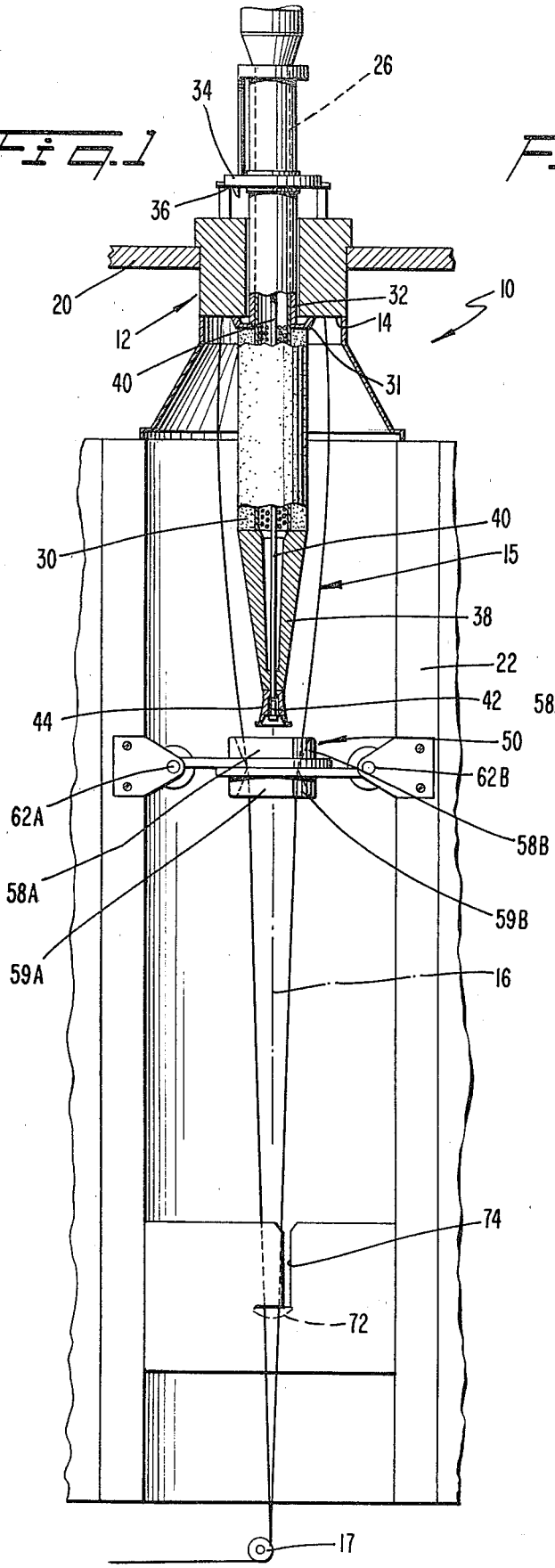
FIG. 1 is a front elevational view of a melt-spinning apparatus, with portions of quench and finish conductors broken away, and with an upper guide in an operative position.

In the figures, there is depicted a melt-spinning apparatus 10 wherein a conventional filter pack 12 includes a conventional spinneret 14 through which is downwardly extruded a molten polymer such as polyester or polyamide for example, to form filaments. The spinneret is of a conventional type comprising holes arranged in a circular pattern so that a group 15 of circularly arranged filaments is formed. The holes of the spinneret are preferrably arranged in a series of circular rows having a common central axis. The spun filaments travel downwardly to a turning guide 17, or a godet or roll, at which they are gathered and redirected, in conventional fashion.

The pack 12 is mounted on a conventional superstructure 20, and the filaments travel downwardly within a cabinet or chimney 22 closed on at least three sides and possibly open at the fourth side for operator monitoring purposes.

Quench gas preferably in the form of cool air is provided to cool the filaments 15 emerging from the spinneret. The quench gas is delivered by a quench conduit which includes a gas supply portion 26 and a gas discharge portion 28. The gas supply portion 26 extends downwardly through the pack 12 and the spinneret 14 in coaxial relationship with the vertical, longitudinal axis 16 defined by the circular array(s) of spinneret holes.

The gas discharge portion 28 of the quench conduit is disposed immediately below the spinneret 14 and includes a plurality of outlet openings for discharging the quench air radially outwardly in a preselected pattern through the surrounding filaments 15. Preferably, a sheath 30 of porous foam surrounds the conduit discharge portion to uniformly disperse the quench air. A collar 31 may be located on the conduit 26 to position the top of the sheath relative to the spinneret.

The section of the gas supply portion 26 extending through the pack 12 is preferably surrounded by an insulator 32 to minimize heat exchange between the quench gas and molten polymer within the pack 12. The insulator 32 may comprise thermal insulation and/or an air gap.

The insulator 32 includes a fixed stop collar 34 which rests upon a stop post 36 of the pack to support the insulator 32 and locate the latter relative to the spinneret. In this fashion, the spacial relationship between the spinneret holes and the uppermost stream of quench gas is maintained constant, to achieve uniformity of the quenching action and minimize birefringence differences between positions.

Extending downwardly from the lower end of the discharge portion 28 of the conduit is a gas streamlining member 38 in the form of a downwardly converging hollow cone. The cone occupies a considerable portion of the space bounded by the converging filaments 16. Air normally drawn downwardly and inwardly by the rapidly traveling filaments is constrained by the cone to flow in a relatively smooth non-turbulent fashion to minimize undesired vibration of the filaments. Thus, air is not sucked into the filament group in large quantities so as to cause turbulence in a dead zone below the quench and hence filament vibration.

It is preferably that the diameter defined by the innermost circular row of holes in the spinneret be at least 5" to allow sufficient room for the gas supply conduit 26 to pass therethrough. Smaller diameters could be employed, but the gas conduit would require higher pressures to conduct an optimum gas flow quantity.

Extending downwardly through the quench conduit 26 and through the air streamlining cone 38, is a finish supply conduit 40 which conducts a suitable finishing liquid. The lower end of the finish supply conduit 40 projects beyond the bottom of the cone 38 and carries a spray nozzle 42. The spray nozzle 42 is fixed by a collar 44 and is oriented to spray the finish liquid, in mist form, in a downward and radially outward direction, so that the liquid passes outwardly through the group of filaments 15 after the latter have been quenched.

As described thus far, the apparatus is similar to that disclosed in a copending patent application Ser. No. 164,425, now U.S. Pat. No. 4,288,207 of William W. Wilkes entitled "Process and Apparatus for Producing Melt-Spun Filaments" and filed on June 30, 1980, See also a related copending application Ser. No. 149,370, now U.S. Pat. No. 4,285,646 of Roland Waite entitled "Process and Apparatus for Quenching Melt-Spun Filaments" and filed on May 13, 1980.

The quench and finish conduits 26, 40 may be arranged to be temporarily raised to an inoperative position (FIG. 2) to facilitate access to the cabinet interior and spinneret.

Disposed immediately beneath the nozzle 42 is an upper filament guide assembly 50 which acts upon the filaments in an inward direction to displace them inwardly toward the longitudinal axis of the filament group in accordance with the present invention. Also, the upper guide so confines the finish to create a concentrated finish environment through which the filaments travel.

Figure 4:
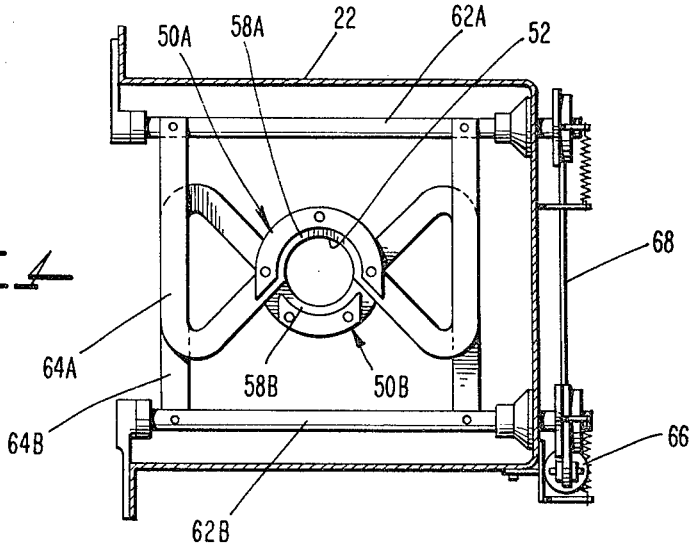
FIG. 4 is a sectional view of the melt-spinning apparatus, taken along line 4—4 in FIG. 3.

Preferably, the guide assembly 50 includes a circular, filament guide surface 52 (FIG. 4) which surrounds the filament group. The guide assembly may be of one piece or, as depicted, may comprise two or more segments 50A,B which can be merged together around the filaments, as explained hereafter. Upper interior walls 58A,B of the segments diverge upwardly from the guide surface 52 and lower interior walls 59A,B diverge downwardly from the guide surface.

The guide segments 50A,B include filament contact portions that form the circular guide surface 52 when the segments have been merged. The guide surface 52 functions to engage the filaments and urge them radially inwardly as will be discussed below.

The guide surface is arranged to reduce the amplitude of vibration of the filaments in a manner which promotes a more uniform quenching and application of finish. Importantly also, the diameter and location of the guide surface are determined to minimize the influence of the guide surface on the mean temperature, velocity, and tension profiles of the filaments in order to avoid any appreciable change in the physical properties of the filaments which would be otherwise established. That is, parameters such as the tension applied to the filaments above the freeze point (i.e., the point at which the filaments reach their final speed), the rate of quench, and the rate of finish application are not to be appreciably changed. Rather, the guide surface is arranged to achieve greater uniformity in the quench and finishing operations (thereby minimizing the birefringence coefficient of variation in filaments being produced), and to reduce the additional tension imposed upon the filaments downstream of the freeze point of the filaments.

In this regard, the guide surface is positioned below the finish nozzle 42 and at or just beneath the freeze point, and the diameter of the guide surface is somewhat less than a normal diameter, i.e., a diameter which would otherwide be assumed by the filaments in the absence of the guide surface, so that the guide surface contacts and supports the filaments and deflects them inwardly toward the longitudinal axis 16 against the force of the outflowing quench air. Thus, the free, unsupported length of the filaments from the spinneret is shortened, whereby the amplitude of vibration of the filaments is greatly reduced (the frequency of vibration being accordingly increased). As noted earlier, the vibratory movement of the filaments toward and away from the longitudinal axis of the filament group can adversely affect the uniformity of quenching and hence filament uniformity. By reducing the amplitude of vibration, the filaments remain closer to the source of quench air and finish spray and thus "see" a more uniform environment.

Also, as the filaments oscillate, they may tend to collide and, if not sufficiently cooled at that point, they may tend to coalesce. This problem is alleviated by the reduction in amplitude of vibration.

The diameter of the guide surface is sufficiently large to assure that the filaments passing therethrough remain in mutually spaced relationship. This promotes a complete distribution and application of finish throughout the filament group. The finish is sprayed downwardly and outwardly so as to initially contact the filaments as the latter enter the upper guide 50. Since the filaments are mutually spaced, the sprayed finish has access to the entire periphery of each filament. Also, the sprayed finish contacts the guide interior walls and flows downwardly across the guide surface 52 to further contact the mutually spaced filaments as the latter slide across the guide surface.

The vertical central axis of the guide surface is aligned with the longitudinal axis 16 of the filament group during a spinning run and is of the same configuration as the filament group (preferably circular), so that all of the filaments are caused to approach the axis of the filament group by the same amount, thus further promoting uniform quenching and application of finish.

The walls of the upper guide are preferably formed of metal, so as to constitute an efficient accumulator and conductor of heat. In this regard, the walls receive heat by radiation from the filaments and by convection from the air flow induced by the moving filaments and traveling therewith. The walls thus serve as a heat sink for assisting in the cooling of the filaments. The finish liquid which drains from the walls serves to rapidly dissipate the accumulated heat.

Those portions of the walls forming the guide surface 52 are preferably of a low-friction ceramic material to promote filament travel.

It will be appreciated that the upper guide 50 of the present invention reduces the diameter of the filament group below the guide 50 and thus reduces the amount of downward air flow which is induced by the filaments. Such air flow is a function of the diameter of the filament group and also increases the tension imposed upon the filaments downstream of the upper guide. By reducing that tension, the likelihood of breakage or other damage occuring to the filament on subsequent guides, etc. is reduced; and the energy required to pull the filaments at a given speed is reduced.

The upwardly and outwardly flared configuration of the inner walls 58A,B of the upper guide effectively strips air flow from around the filaments above the upper guide. That is, as the filaments pass through the guide, the downward air flow induced by the filaments and traveling downwardly between the filaments and the finish-confining wall segments 58A,B is caused, upon reaching the region of the contact surface, to reverse direction, thereby reducing the air drag on the filaments at that point.

The lower wall segments 59A,B further confine the finish spray and prevent the spray from being thrown outwardly by turbulent air flow.

Figure 2:
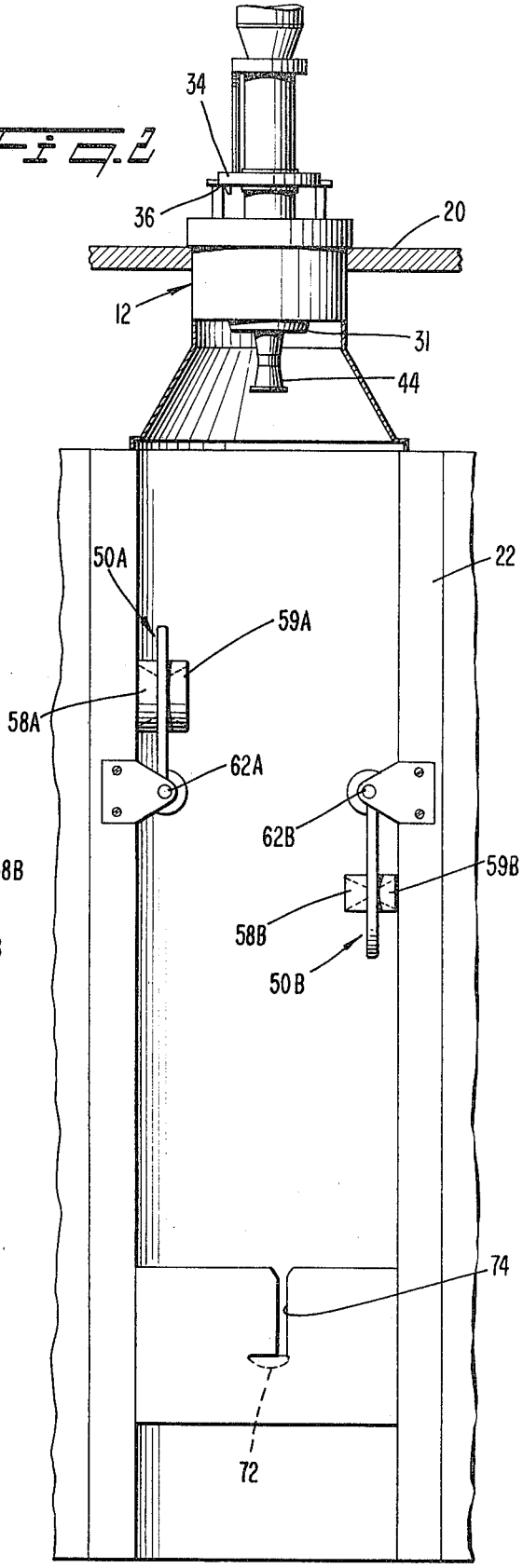
FIG. 2 is a front elevational view of the melt-spinning apparatus with the upper guide in an inoperative position and with the quench and finish conduits in a raised condition.
Figure 3:
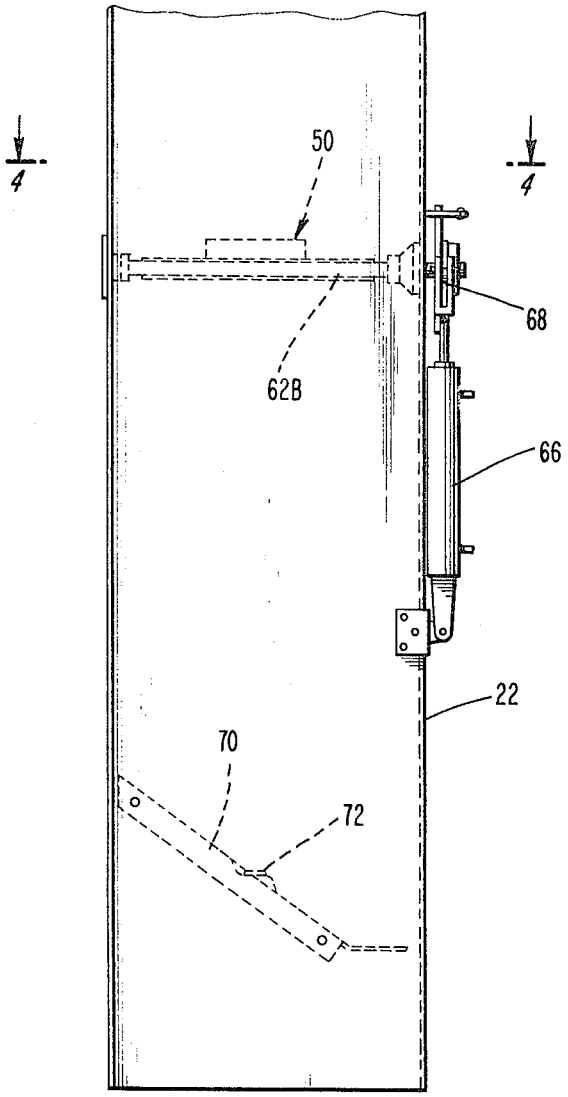
FIG. 3 is a side elevational view of the melt-spinning apparatus taken ninety-degrees relative to the view depicted in FIGS. 1 and 2 and with the upper guide in an operative position.

The guide surface 52 may be formed in various ways, such as by a one-piece member through which the filaments are threaded, or by a multi-segmented arrangement, as shown in FIGS. 1–2 which is merged around the filaments to avoid the need for threading of the filaments. As regards the latter approach, the guide segments are mounted on separate carrier shafts 62A,B by means of support arms 64A,B, the latter being situated in vertically spaced planes. By rotating the shafts 62A,B about their own axes, the arms and associated guide segments can be raised and lowered. The shafts are rotated simultaneously by means of a pneumatic cam 66 which is operatively connected to the shaft 62B, the latter being drivingly connected to the other shaft 62A by a connecting rod 68.

In a non-merged condition of the guide segments, the filaments are free to travel in their normal or natural travel paths. However, when the guide segments are merged, they close in around the filaments and make contact therewith to deflect the filaments radially inwardly toward the vertical longitudinal axis of the filament group.

At a lower end of the cabinet 22 above the turning guide 17, an inclined surface 70 is provided. The surface includes a guide opening or through passage 72 and a slot 74 enabling the filament group to be inserted into the guide opening. As the filaments travel through the guide opening 72, air traveling around the filament bundle 15 is stripped from the filament group upon engaging the inclined surface 70 and guide opening and is conducted in a different direction to an outlet duct. This reduces the quantity of air flow emerging with the filaments from the cabinet 22, which air flow could otherwise cause disturbance below the plate, e.g., operation at the turning guide 17.

MODIFIED QUENCH/FINISH APPLICATOR

A slightly modified form of the quench/finish applicator is illustrated in FIGS. 5 and 6. An insulation unit 32A is depicted which is fixed within the pack 12. The insulation unit comprises spaced tubes 80, 82 between which is disposed a layer of thermal insulation. An end cap 84 is disposed at the top of the tubes 80, 82 and carries a spring-biased ball retainer 86. A locating ring 88 is mounted to the outer tube 80 below the cap 84 rests upon a post 94 on the pack to locate the insulator. The ring 88 includes an aperture within which is pivotably mounted a hook 90. The hook is actuated by means of a spring-biased rod 92, the upper end of which is disposed within a hole in the cap 84. The hook 90 is engagable with the post 94 such that by lifting the rod 92 the insulator can be removed from the pack.

The quench conduit 26A is slidable within the insulation unit 32A and includes an annular recess 96 which receives the ball retainer 86 to be held in an upwardly retracted condition (FIG. 5). When raising the quench conduit 26A, the hook 90 prevents unintended raising of the insulator from the pack. The foam sheath 30 has been removed from the quench conduit 26A in FIGS. 5, 6 as required in order to enable the quench conduit to be retracted (FIG. 5) or completely removed from the spinneret (FIG. 6). The cone 38A is narrower than the cone of the embodiment of FIGS. 1, 2 to enable the porous sheath to be slid upwardly over the cone. The sheath is held in place by means of a retaining collar (not shown) which slides up over the cone 38A and is secured by means of a bayonet-type connection with lugs 96 on the cone.

OPERATION

In operation of the filament-fabricating apparatus, molten polymer is extruded downwardly through the spinneret 14 to form a circularly arranged group of filaments 15. The filaments 15 travel through the upper guide 50. If the upper guide is of one-piece construction, the filaments are threaded therethrough. If a multi-segmented guide 50 is employed, as illustrated herein, the guide can be formed around the filament group.

The guide surface 52 of the guide contacts the filaments and deflects them inwardly from a normal travel path toward the longitudinal axis of the filament group against the force of the outflow quench air. Thus, the filaments are supported intermediate the spinneret and the lower guides 17 and 72 whereby the amplitude of vibration of the filaments is reduced to promote more uniform quenching and finish applying operations. As a result, birefringence coefficient of variation characteristics are improved, as reflected by the following test results, wherein the wind-up speed and rate of quench air flow are varied. It is expected that the present invention is well suited for the spinning of all polyesters, polyamides, and polyolefins.

The test involved the spinning of 0.62 dl/g i.v. polyethylene terephthalate (measured in an 8% solution of orthochlorophenol). The spinneret had 1904 holes of 0.009 in. diameter and 0.012 in. length. The holes were arranged in 7 rows, the center row being of 5.5 in. diameter and the outer row being of 6.5 in. diameter. The spinneret temperature was 290° C. and the quench air temperature was 105° F. In all cases quenching commenced at $1\frac{5}{8}$ inches below the spinneret.

As can be seen from the chart, columns 1–3 represent birefringence values while columns 4–6 represent birefringence coefficient of variation in percentage. Columns 1 and 4 reflect conditions when quench (but not finish) was applied without the stripping surface 70 and the upper guide 50; columns 2 and 5 reflect the addition of the stripping surface 70 at 62 inches below the spinneret; and columns 3 and 6 reflect the addition of a finish application as well as the stripping surface 70 (at 62 inches below the spinneret) and the upper guide 50. (at 27 inches below the spinneret)

| Wind-up Speed | Quench air | Polymer Through-put | Birefringence | | | Birefringence Coefficient of Variation (%) | | |
|---|---|---|---|---|---|---|---|---|
| ft/m. | cfm | LB/HR. | 1 | 2 | 3 | 4 | 5 | 6 |
| 8500 | 360 | 190 | 37.2 | 38.1 | 35.3 | 8.1 | 5.8 | 4.8 |
| 7500 | 360 | 180 | 32.6 | 28.8 | 27.1 | 11.1 | 3.4 | 4.8 |
| | 325 | 180 | 27.5 | 30.1 | 26.7 | 9.3 | 8.0 | 2.9 |
| | 300 | 180 | 29.3 | 31.2 | 28.7 | 8.5 | 6.6 | 6.3 |
| 6500 | 340 | 167 | 22.1 | 27.9 | 20.2 | 4.8 | | 3.6 |
| | 315 | 167 | 25.3 | 22 | 20.2 | 12.2 | 3.0 | 3.0 |
| | 290 | 167 | 22.5 | 21 | 20.8 | 7.5 | 5.1 | 3.8 |
| 5000 | 300 | 150 | 13.6 | 14.1 | 13.5 | 10.7 | 7.6 | 5.7 |
| | 275 | 150 | 12.9 | 14.4 | 13.5 | 8.2 | 7.1 | 5.2 |
| | 250 | 150 | 15.6 | 14.6 | 13.1 | 9.2 | 6.1 | 5.0 |
| 4000 | 270 | 140 | 9.2 | 10.6 | 8.7 | 8.9 | 10.1 | 4.5 |

It will be appreciated that improved birefringence coefficient of variation characteristics (Col. 6 vs. Col. 4 ) were achieved with the present invention; especially at higher wind-up speeds.

The tension induced in the filaments below the upper guide 50 was also significantly reduced as is apparent from the following chart in which Tension Column No. 1 represents filament tension without the upper guide and Tension Column No. 2 represents filament tension with the upper guide.

| Wind-up Speed | Tension (gm/den) | | Yield Stress |
|---|---|---|---|
| (ft/min) | 1 | 2 | (gm/d) |
| 6,000 | 0.1 | 0.06 | 0.37 |
| 5,000 | 0.12 | 0.07 | 0.60 |
| 6,500 | 0.17 | 0.10 | 0.45 |
| 7,500 | 0.25 | 0.13 | 0.48 |
| 8,500 | 0.30 | 0.16 | 0.51 |
| 9,500 | 0.36 | 0.19 | 0.54 |

It has been found that the upper guide produces optimum advantages involving reduced birefringence coefficient of variation, and reduced tension in instances where the spinneret contains more than 1,000 holes, the quench air flow is at least 90 cu.ft./min., the polymer throughput is not greater than 1 pound/hour per cu.ft./-min. of throughput and the wind-up speed is no greater than 13,000 ft./min. A Spraying System Co. LN 4 atomizing nozzle at 20 to 30 psi pressure, was used to spray an aqueous emulsion of surfactant.

It will be appreciated, then, that the present invention greatly stabilizes the filaments and desensitizes the filaments relative to ambient conditions, possibly to an extent eliminating the need for a surrounding cabinet. There are produced significant reductions in the birefringence coefficient of variation by means of a guide surface which maintains the filaments in mutually spaced relationship so as to promote the uniform application of finish. Since the guide surface only partially converges the filaments, it can be disposed at a high level (i.e., closer to the spinneret) so as to be extremely effective in reducing the unsupported filament length and thereby lessening the amplitude of filament vibration without significantly altering the threadline profile. Such would not be the case if the guide completely converged the filaments because the guide would have to be placed at a lower level to avoid contact between the filaments and the finish nozzle.

The convergence of the filaments below the guide (i.e., reduction in diameter of the filament group), significantly reduces the air drag (tension) acting on the filaments. This lessens the risk of subsequent filament damage and lowers energy expenditures.

By positioning the upper guide 50 beneath a finish spray nozzle, it is assured that finish flows onto and fully lubricates the guide surface 52 and flows onto the filaments engaging that surface.

The guide walls projecting above the guide surface 52 serve to confine the finish spray in a region surrounding the filaments to further promote the application of finish.

The guide walls also serve to absorb heat from the induced air flow and from the filaments, to aid in filament cooling. The flow of finish liquid along the wall aids in dissipating the absorbed heat.

MODIFIED UPPER GUIDE

Figure 9:
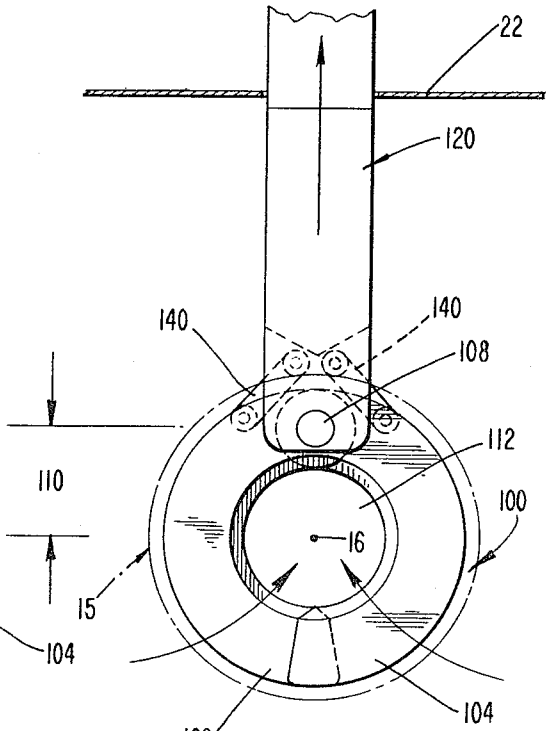
FIGS. 7, 8 and 9 are plan views of the modified upper guide of FIGS. 5–6, depicting its sequence of operation.

A more preferred form of upper guide is depicted in FIGS. 5–14. As illustrated in plan view in FIGS. 7–9, the upper guide 100 comprises a pair of cooperable jaws 102, 104 which wrap around the filament group 15. In particular, the jaws approach the filaments from the side in an open condition (FIGS. 7 and 8), and then close around the filaments to surround and converge the filaments (FIG. 9). The jaws swing closed about a vertical pivot 108 generally coincident with the main longitudinal axis 16 of the filament group, and are thereafter displaced by a slight amount 110 in a horizontal direction to realign the longitudinal axis of the converged filament group (i.e., the central axis of the opening or through-passage 112 defined by the closed jaws) with such main longitudinal axis 16 (FIG. 9).

Figure 13:
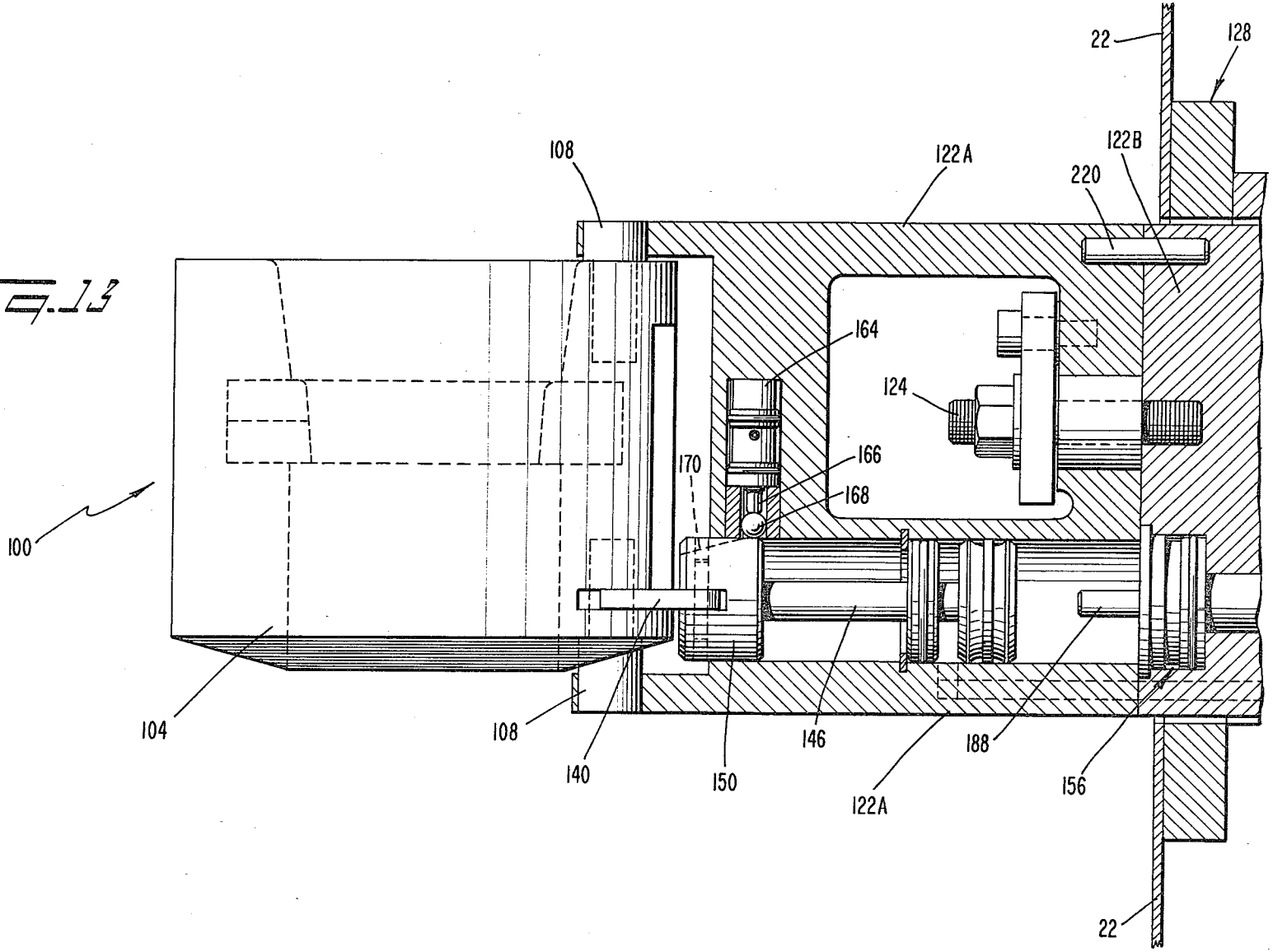
FIG. 13 is a fragmentary longitudinal sectional view through a front portion of the modified upper guide, with that guide in a normal operational mode corresponding to FIG. 9.

As depicted more clearly in FIGS. 10 and 13, the jaws 102, 104 are mounted by means of a vertical pivot pin 108 to the front end of a fluid-actuated motor, preferably in the form of a pneumatically actuated ram assembly 120. The ram assembly 120 includes a carrier 122, including front and rear parts 122A, 122B which are releasably interconnected by a threaded bolt 124.

The carrier 122 is reciprocated forwardly (toward the filaments) and rearwardly (away from the filaments) by a pneumatic ram 126 which is mounted upon a frame 128 that is fixed to the side of the cabinet or chimney 22. The ram 126 includes a reciprocable rod 130 which is threadedly secured to the rear end of the rear carrier part 122B. Upon the carrier 122 are mounted rollers 132, 134 which travel freely within a pair of guide slots 136, 138 in the frame 128. The front and rear ends of the slots 136, 138 may define the front and rear ends of the travel stroke of the head 122; alternatively, adjustable stop bolts (not shown) may be inserted into the front and rear ends of one of the slots to define adjustable stop positions for the stroke.

The jaws 102, 104 are connected, by means of a pair of links 140, to a jaw actuator mechanism 144. The jaw actuator mechanism 144 includes a reciprocable rod 146 to the rear end of which is mounted a piston 148, and to the front end of which is mounted a head 150. Rear ends of the links 140 are pivotably connected to the head 150 for movement therewith. The rod 146 is slidable within a bore 152 in the front carrier part 122A, which bore is sealed by means of seals 154, 156 disposed at opposite sides of the piston 148. Pneumatic conduits 158, 160 (FIG. 14) communicate with the bore 150 on opposite sides of the piston 148, such that pneumatic fluid introduced into the bore 152 forwardly of the piston 148 via the conduit 158 serves to retract the rod 146 and open the jaws 102, 104 (FIGS. 7–8), and pneumatic fluid introduced behind the piston 148 via a conduit 160 serves to extend the rod 146 and close the jaws. The flow of pneumatic fluid to the jaw actuator mechanism 144 is controlled by means of a valve 162 which is mounted within the rear carrier part 122B, as will be discussed hereinafter.

Mounted in the front carrier part 122A is a valve 164 (FIG. 13) which controls the supply of pneumatic fluid to the ram 126. The valve 164 is of a conventional type and includes a reciprocable stem 166 that rests upon a ball 168, the latter being slidably retained in a ball mount. The ball rolls along a sloped cam surface 170 on the head 150. When the head is extended forwardly (to close the jaws), it raises the ball to actuate the valve 164 in a manner directing fluid to the rod side of the ram 126, causing the ram 126 to retract. Thus, the jaws are automatically retracted after being closed.

In order to regulate the distance of that retraction, the carrier 122 carries a pivoted latch 172 which is urged to an outward latching position (FIG. 12) by means of a compression spring 174. Mounted on the framework 128 is an adjustably movable abutment or striker plate 176 which includes a latch-receiving recess 178. Thus, when the carrier is retracted from a fully extended position, with the latch in a latching mode, the latch enters the recess 178 and halts further retraction of the carrier.

The latch 172 is controlled by means of a latch actuator mechanism 180 which includes a reciprocable pin 182. The pin 182 is reciprocable within a bore 184 which is disposed in the rear carrier part 122B and is aligned with the bore 152 of the front carrier part 122A. The pin 182 is biased forwardly by a compression spring 186 so that a front end 188 of the pin projects through an opening in the seal 156 and into the bore 152 when the jaw actuator rod 146 is in an extended condition (FIG. 13). The pin 182 carries a spool 190 which includes a recess 192. Mounted in the rear carrier part 122B is a ball 194 which is situated between the spool 190 and one end of the latch 172. With the pin 182 in an extended position (by means of the spring 186), the recess 192 is aligned with the ball 194 to receive the latter, allowing the latch to be spring-urged outwardly (i.e., a latching mode). When the pin 182 is in a retracted condition, as by being pushed rearwardly by the piston 148 of the jaw actuator rod 146, the spool 190 pushes the ball 194 against the latch 172 to retract the latter against the bias of the spring 174 to an unlatching mode. In such a condition of the latch 172, the carrier can be fully retracted.

Figure 14:
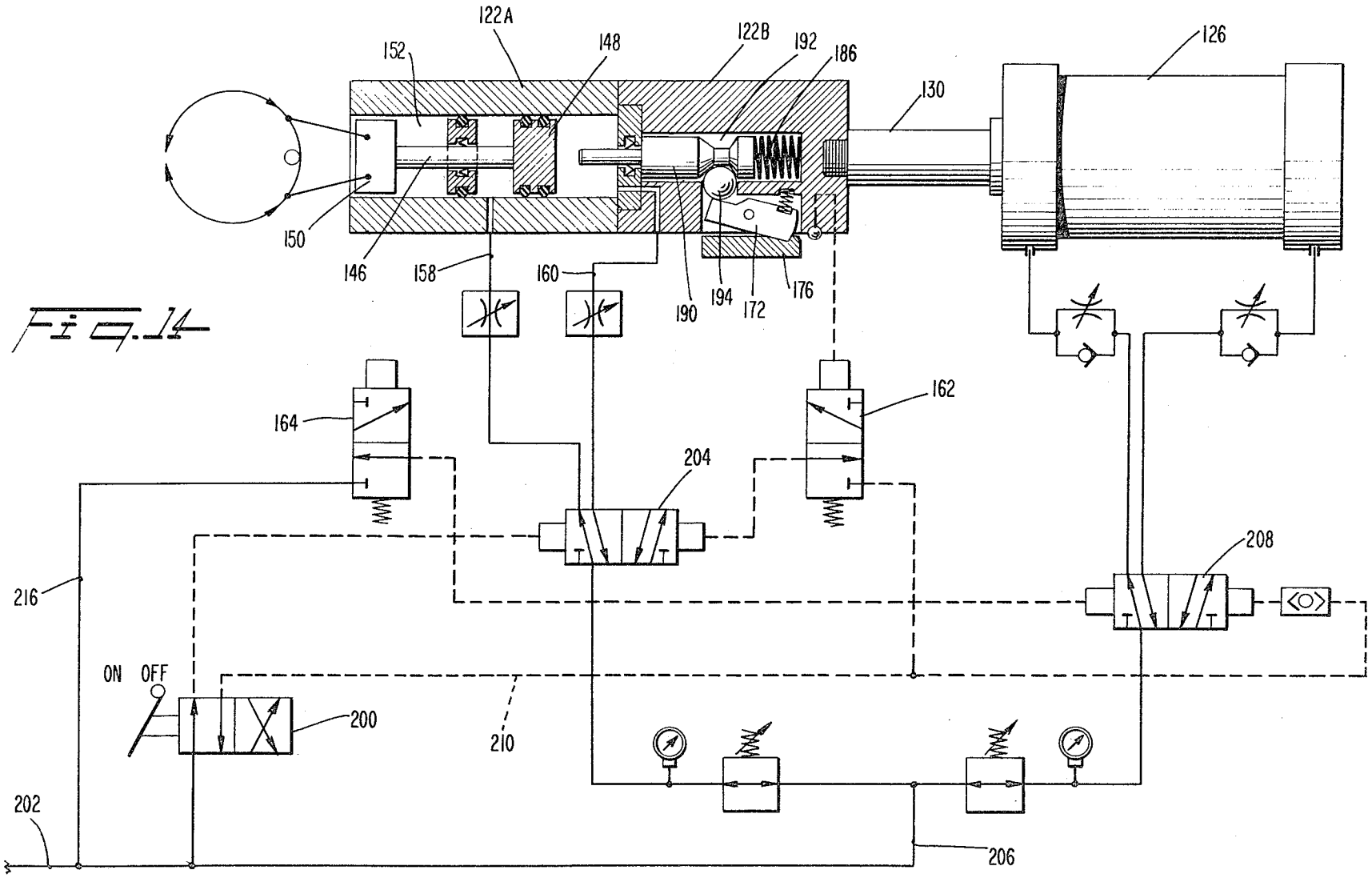
FIG. 14 is a schematical representation of the modified upper guide and the pneumatic system for its operation, with no particular mode of operation of the guide being depicted.

Operation of the upper guide 100 will be more clearly understood with reference to FIG. 14 which schematically depicts the elements of the control system but not in any particular mode. Before a spinning run commences, a manual control valve 200 is in an "off" mode, wherein pressurized pneumatic fluid from a supply conduit 202 is directed to one side of a main valve 204 (i.e., the left side in FIG. 14) to bias the latter to a jaw-open mode, wherein pneumatic fluid from a conduit 206 is delivered to the front side of the piston 148 to retract the latter and hold the jaws open. The valve 164 (FIG. 13) in the front carrier part 122A is thus influenced by the low end of the cam surface 170 of the head 150 and assumes a position which permits a ram control valve 208 to assume its normal position (as depicted), directing fluid to the rod end of the ram 126.

Figure 8:
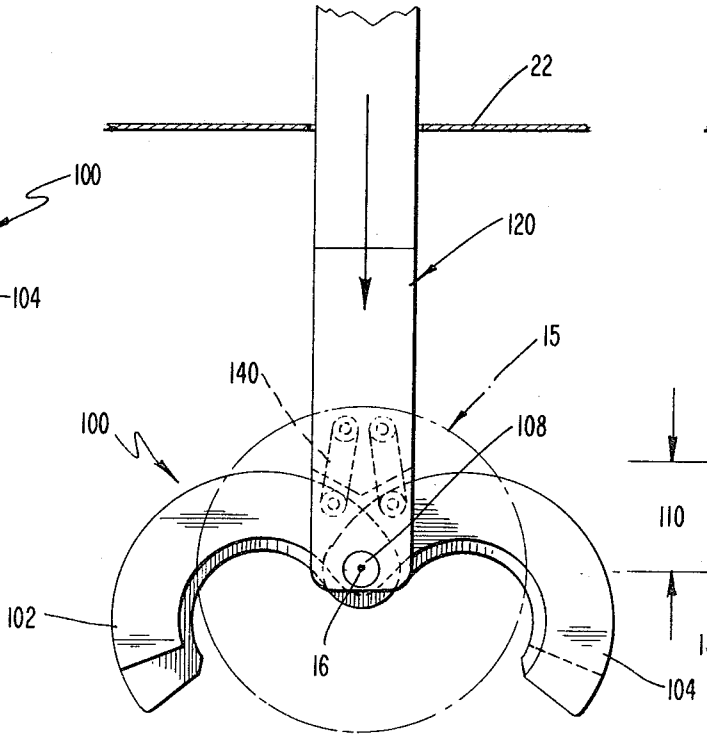
Figure 7:
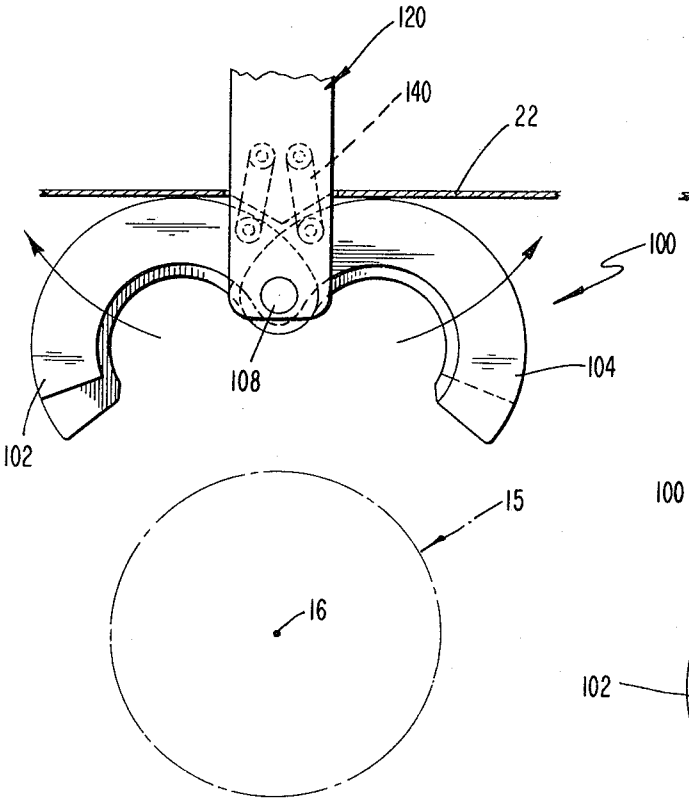
Figure 11:
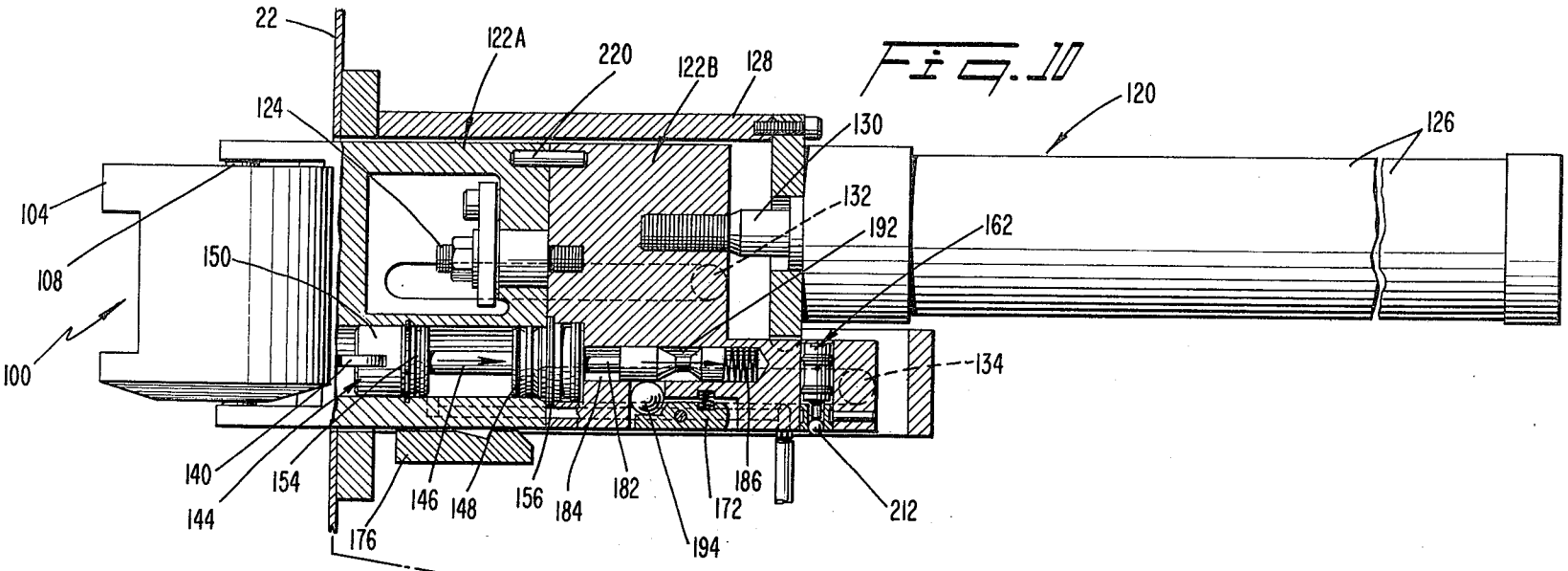
FIG. 11 is a view similar to FIG. 10 with the modified upper guide in a fully extended mode, corresponding to FIG. 8.
Figure 11:
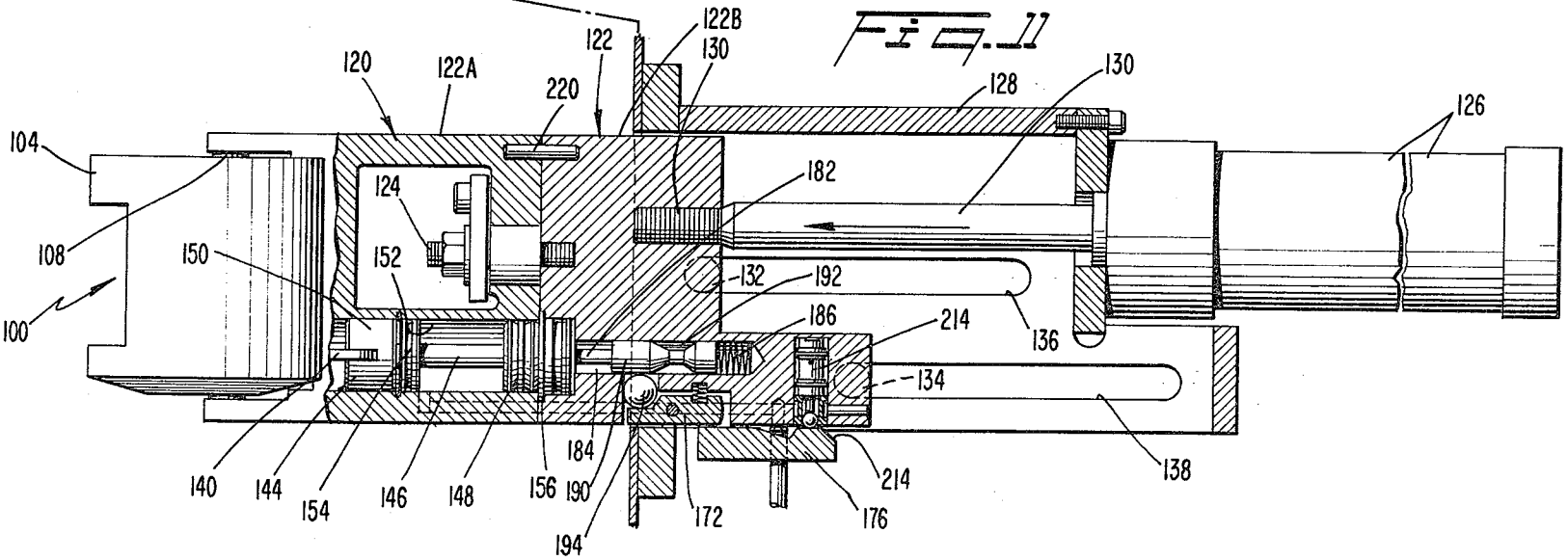
Figure 12:
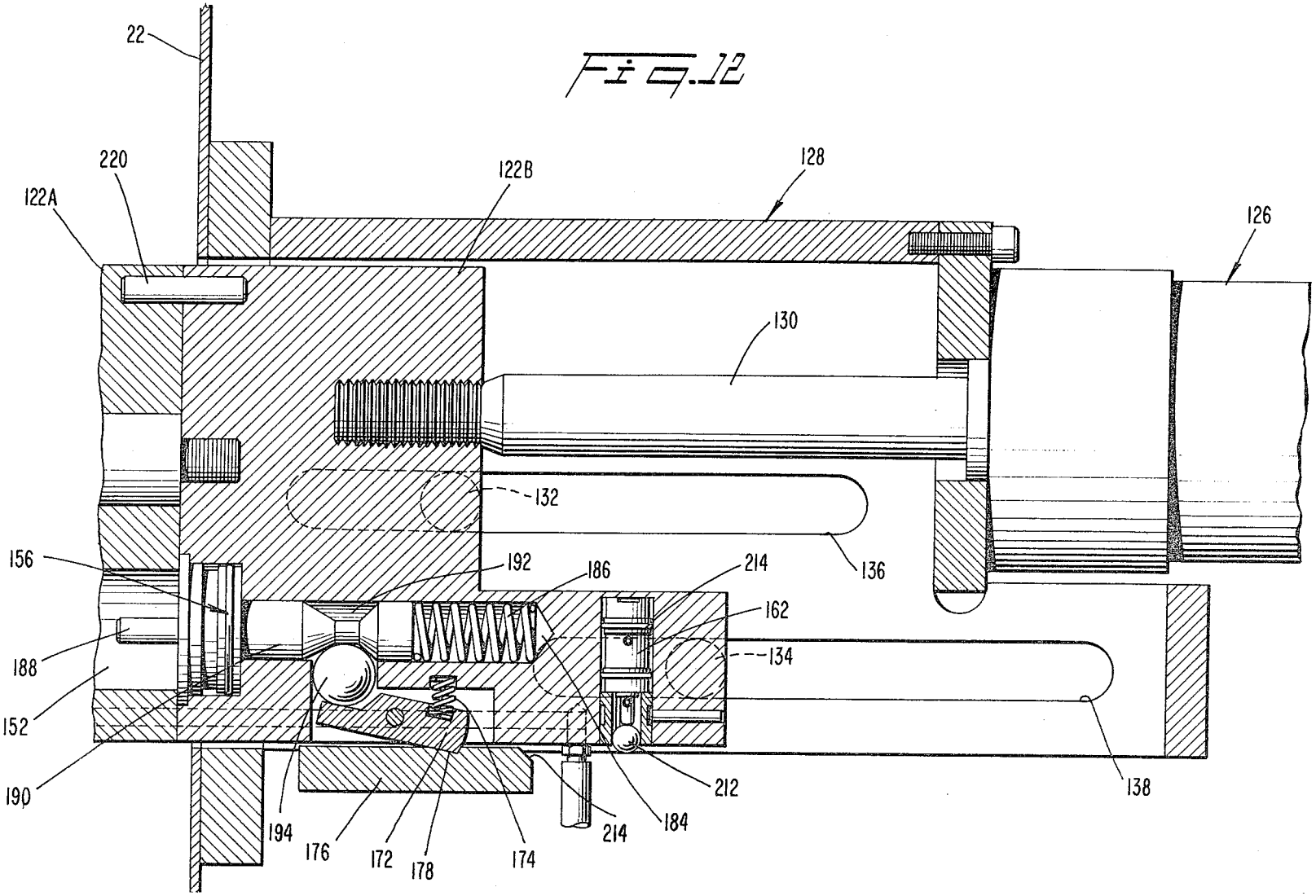
FIG. 12 is a fragmentary longitudinal sectional view through a rear portion of the modified upper guide, with that guide in a normal operational mode corresponding to FIG. 9.

When the manual valve 200 is shifted to an "on" position, pneumatic fluid is delivered via the conduit 210 to a side of the ram control valve 208 (i.e., the right side in FIG. 13) to shift the latter in a manner delivering pneumatic fluid from the conduit 206 to the piston side of the ram 126. Hence, the ram 126 extends the carrier 122 and jaws 102, 104 toward the filaments being spun (FIGS. 8, 10, 11). During this travel, the latch 172 is held retracted by the ball 194, and the jaws continue to be held open. Upon the carrier reaching a fully extended position, as governed by the front ends of the slots 136, 138 (or adjustable bolts therein), the pivot axis 108 of the jaws is generally aligned with (or perhaps extends somewhat beyond) the longitudinal axis 16 of the filament group, some of the filaments having been engaged and pushed laterally by the open jaws. At this point, a ball 212 of the valve 162 rides upwardly upon a ramp 214 (FIG. 11) of the abutment 176, shifting the valve 162 to a position delivering pneumatic fluid from the conduit 210 to a side of the main control valve 204 (i.e., the right side in FIG. 13) to displace the latter. Accordingly, pneumatic fluid from the conduit 206 is directed by the valve 204 to the rear side of the piston 148, causing the rod 146 to extend and close the jaws around the filaments. Since the cross-sectional area of the jaw-defined through-passage is smaller than that of the filament group, the filament group is converged, short of mutual contact.

At this point, the center of the opening 112 defined by the jaws is spaced laterally of the main longitudinal axis 16 of the filament group leaving the spinneret. Accordingly, it will be understood that once the jaws have been closed, the valve 164 is actuated by the head 150 and directs pneumatic fluid from a conduit 216 to a side (i.e., the left side in FIG. 13) of the ram-actuating valve 208 which causes shifting of the latter to a position directing pneumatic fluid to the rod side of the ram 126. As a result, retraction of the ram 126 is initiated. Since the latch-controlling ball 194 had become aligned with the spool recess 192 (due to the spring 186) when the rod 146 was fully extended (to close the jaws), the latch 172 is in a latching mode. Hence, the ram 126 is capable only of partial retraction before the latch 172 enters the recess 178 and terminates further movement of the carrier 122. Understandably, the abutment 176 is in a position of adjustment assuring that when the carrier stops, the longitudinal axes of the jaw opening 112 and the filament group are coincident. Spinning then continues with the upper guide 100 in this partially retracted condition.

When the manual valve 200 is eventually shifted to the "off" mode, the valve 204 shifts to a position causing the jaw actuator rod 146 to retract thereby opening the jaws. Simultaneously, the piston 148 pushes the pin 182 to a retracted position to force the latch 172 inwardly to an unlatching mode. Hence, the ram 126 is free to complete its retraction stroke.

It will be understood that pneumatic fluid is delivered to the valve 164 within the front carrier part 122A in any suitable manner, such as through guide pins 220 (only one depicted) which extend between the front and rear carrier parts 122A,B.

The jaw 102 includes a lug 222 (FIG. 5) which enters a corresponding notch 224 in the other jaw 104 to produce a secure mating of the jaws, and also forming the interface between the jaws as a tortuous path for fluid, thereby resisting leakage of finishing liquid therethrough.

It will be appreciated that the guide 100 is effectively merged around the filaments and yet occupies a relatively small amount of space within the cabinet in its extended and retracted positions. Since the jaws are mounted on a common carrier, there is less chance for misalignment to occur beween the jaws or between the jaws and the filaments.

Although the invention has been described in connection with a preferred embodiment thereof, it will be appreciated by those skilled in the art that additions, modifications, substitutions, and deletions may be made without departing from the spirit or scope of the invention as defined in the appended claims.

What is claimed is:

1. In a melt-spinning process of the type wherein molten polymer is extruded downwardly through annularly arranged holes of a spinneret to form an annular group of filaments, quench gas is directed from within the filament group and outwardly therethrough, finish liquid is sprayed from within the filament group and outwardly therethrough beneath the quench gas, the filaments are gathered and redirected at a lower guide means, and the filaments exhibiting vibration during travel from the spinneret to the lower guide means, the improvement comprising the step of passing the filaments through an upper annular guide means disposed around the filament group below the finish spray and above the lower guide means but no higher than the freeze point of the filaments such that the upper guide means is lubricated by the finish spray and the filaments are contacted and acted inwardly upon by a surface of the upper guide means and deflected thereby, in mutually spaced annular relationship, toward a longitudinal axis defined by the filament group such that a diameter defined by the filament group passing through said upper guide means is smaller than a diameter defined by said filament group emerging from said spinneret, whereby the filaments are suppported between the spinneret and the lower guide means to reduce the amplitude of vibration of the filaments.

2. The process according to claim 1, including the step of confining finish spray around the filaments between wall means above the upper guide means through which the filaments travel.

3. The process according to claim 1, wherein the quench gas is conducted downwardly through the spinneret.

4. The process according to claim 3, wherein the finish liquid is conducted downwardly through the quench gas.

5. The process according to claim 1, wherein the filament wind-up speed is no greater than 13,000 ft./min.

6. The process according to claim 1, wherein said polymer is a polyester.

7. The process according to claim 6, wherein said polyester is polyethylene terephthalate.

8. In a melt-spinning process of the type wherein molten polymer is extruded downwardly through circularly arranged holes of a spinneret to form a circular group of filaments, quench gas is conducted downwardly through the spinneret in alignment with a longitudinal axis defined by the filament group and is directed outwardly through the filament group; finish liquid is conducted downwardly through the spinneret in alignment with the longitudinal axis and is directed outwardly through the filament group below the quench gas, the filaments are gathered and redirected at a lower guide means, and the filaments exhibiting vibration during travel from the spinneret to the lower guide means, the improvement comprising the steps of:

passing the filaments through and against a circular upper guide surface disposed around the filament group above the lower guide means, such that the upper guide surface is lubricated by the finish spray and the filaments are deflected inwardly by the guide surface in mutually spaced relationship, toward the longitudinal axis, whereby the filaments are supported between the spinneret and the lower guide means to reduce the amplitude of vibration of the filaments, passing the filaments between wall means extending upwardly and outwardly from the guide surface and surrounding the filament group, and spraying finish liquid onto the wall means so that a finish environment is confined between the wall means.

9. A process according to claim 8, including the step of passing the filament group through an additional guide and an inclined surface to strip air from around the filament group.

10. Process according to claim 1 which comprises spraying a mist.

11. Process according to claim 8 which comprises spraying a mist.

* * * * *